US008659419B2

(12) United States Patent
Cao et al.

(10) Patent No.: US 8,659,419 B2
(45) Date of Patent: Feb. 25, 2014

(54) METHOD AND APPARATUS FOR PREVENTING PERSON, ANIMALS OR ITEMS FROM GETTING LOST

(76) Inventors: Zhiheng Cao, Irvine, CA (US); Qingqi Dou, Irvine, CA (US)

( * ) Notice: Subject to any disclaimer, the term of this patent is extended or adjusted under 35 U.S.C. 154(b) by 351 days.

(21) Appl. No.: 12/972,467

(22) Filed: Dec. 18, 2010

(65) Prior Publication Data

US 2012/0154147 A1 Jun. 21, 2012

(51) Int. Cl.
*G08B 1/08* (2006.01)

(52) U.S. Cl.
USPC ..... 340/539.13; 340/539.15; 340/539.1

(58) Field of Classification Search
USPC ..... 340/539.13, 573.4
See application file for complete search history.

(56) References Cited

U.S. PATENT DOCUMENTS

| | | | | |
|---|---|---|---|---|
| 6,611,556 | B1 * | 8/2003 | Koerner et al. | 375/224 |
| 8,305,195 | B2 * | 11/2012 | Perng et al. | 340/10.34 |
| 2001/0030603 | A1 * | 10/2001 | Arens | 340/506 |
| 2002/0101353 | A1 * | 8/2002 | Radomsky et al. | 340/573.4 |
| 2002/0174160 | A1 * | 11/2002 | Gatto et al. | 709/1 |
| 2005/0057359 | A1 * | 3/2005 | Coffey et al. | 340/539.21 |
| 2005/0111449 | A1 * | 5/2005 | Moorti et al. | 370/389 |
| 2007/0265887 | A1 * | 11/2007 | McLaughlin et al. | 705/4 |
| 2008/0291031 | A1 * | 11/2008 | Chen et al. | 340/573.4 |
| 2010/0097237 | A1 * | 4/2010 | Christiansen | 340/686.6 |

FOREIGN PATENT DOCUMENTS

WO WO 0179959 A2 * 10/2001

* cited by examiner

*Primary Examiner* — Kerri McNally

(57) ABSTRACT

Methods and apparatus for giving audible warning to a user when one or more accompanying person, animal or personal item is physically more than a predetermined distance away from the user, have a master tag and one or more slave tags, wherein said master tag is wirelessly coupled to each one of said slave tags, said master tag and said slave tag being capable of being conveniently carried by a person or being attached to an animal or a personal item.

16 Claims, 9 Drawing Sheets

METHOD AND APPARATUS FOR PREVENTING PERSON, ANIMALS OR ITEMS FROM GETTING LOST

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND OF THE INVENTION

1. Field of the Invention

This invention relates to electronics consumer products with radio wave communication capability coupled with audible signal generators, and means to control the audible signal generators.

2. Description of the Related Art

Various systems for locating a lost or misplaced object have been proposed to date, such as those disclosed in U.S. Pat. Nos. 4,101,873, 4,476,469, 5,638,050, 5,939,981, 6,147,602, 6,462,658, 6,535,125, 6,674,364, 7,064,662, and 7,551,076. These systems typically comprise a radio wave transmitter tool carried by a user or fixed on a wall, and a radio wave receiving tag which is attached to an object that may become lost or misplaced. When the user presses a button on the transmitter tool, an audible alarm on the tag sounds to allow the user to locate the lost or misplaced object.

There are related arts such as U.S. Pat. Nos. 6,967,563 and 7,755,490 which provide inventory control systems using radio frequency identification tag attached to each item, which communicates with a computer to indicate whether the item is present or absent.

BRIEF SUMMARY OF THE INVENTION

The present invention provides a method and an apparatus for giving audible warning to a user when one or more accompanying person, animal or personal item is physically more than a predetermined distance away from the user. Audible warning signals are also given to the person or animal. When the person, animal or items return to within a predetermined distance from the user, audible warning signals automatically stop. An embodiment of the present invention includes two or more matching tags, one of which, referred hereafter as "master tag" can be carried by the user, the other tags, referred hereafter as "slave tags" cab be carried by or physically attached to one or more accompanying person, animal, or personal item.

Unlike related art, no user action such as pressing a button is needed in order to generate or stop audible signals from either the master tag or any of the slave tags. One usage scenario would be parents taking their children to amusement park. The parents would carry the master tag and each child would carry one of slave tags. The parents may get distracted while one of their children gets too far away from the parents. Systems in prior arts would not be useful in such situation, since when the parents realize that one of their children is missing and presses a button to search for the child, it may already be too late; i.e. the child may have already gone out of the range of the system. An embodiment provided by the present invention gives the parents audible warning (from either the master tag or the slave tag or both) when any one of their children gets too far away, and the slave tag attached to the child who is wandering away also emits audible signals to alert the child while helping the parents to locate the child. Therefore the child is effectively prevented from getting lost.

Circuitry and methods disclosed in the present invention allow each tag in an embodiment to be powered by a small battery, and the size of each tag to be made sufficiently small to be unobtrusively attached to or carried by a person, a pet animal or a personal item. Each tag in an embodiment includes a battery, a radio frequency (RF) transceiver, a microcontroller, and one or more audible signal generator such as a piezo buzzer. The microcontroller and/or RF transceiver include power saving circuitry and control methods to reduce the power consumption needed to maintain periodic communication links with the other matching tags. Each tag is powered by a small battery with battery life in excess of several months to over a year. The microcontroller includes circuitry and control method to determine the approximate physical distance of the other matching tags by using a received signal strength indicator (RSSI) value and/or timing information. The physical distance needed for the audible warning to sound may be programmed in factory according to applications or may be adjusted by the end user during usage.

A light emitting device such as a light emitting diode (LED) may further be included in the master tag and/or each slave tag to indicate preferably by color the status of the system, such as red if battery needs replacing, or green if the system is ready and can be counted on to provide audible warning when it is supposed to. Multiple LEDs can also be provided for embodiments that support multiple slave tags to indicate the status of each slave tag.

BRIEF DESCRIPTION OF THE SEVERAL VIEWS OF THE DRAWING

The invention can be better understood with reference to the following detailed description together with the appended drawings in which like elements are numbered the same.

DETAILED DESCRIPTION OF THE INVENTION

Construction

Figure 1A:
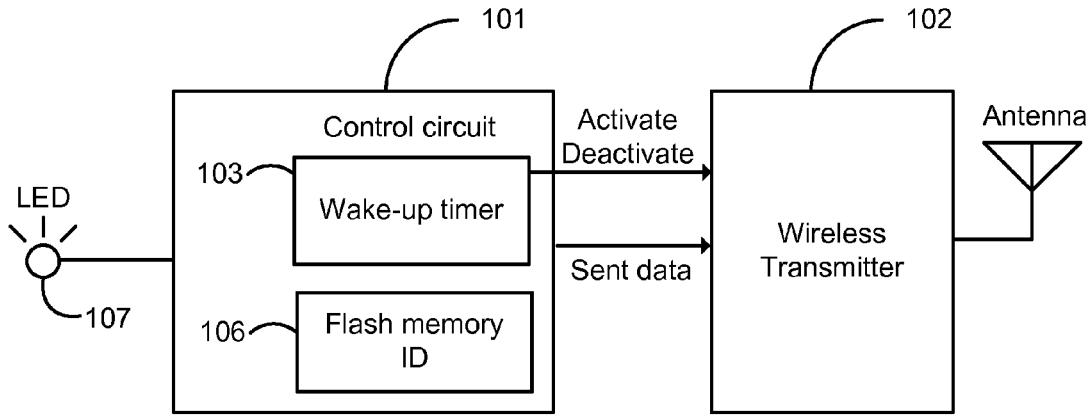
FIG. 1A depicts a functional view of an embodiment of a master tag of the present invention.

FIG. 1A shows an embodiment of a master tag, preferably assembled on a printed circuit board (PCB). A control circuit 101 is preferably implemented using widely available general purpose microcontroller integrated circuits (IC) such as part number C8051F300 from Silicon Laboratories (SiLabs). The control circuit 101 preferably includes a flash memory device 106 to store one or more identification (ID) information unique to each master tag, and control flows disclosed in the present invention in the form of a firmware program. Other types of microcontroller IC may also be used for control circuit 101 and ID information can be stored using jumper switches or stored in Random Access Memory (RAM) found in most microcontroller ICs.

A wireless transmitter 102, is preferably implemented by using a 315 MHz/433 MHz band RF transmitter IC typically found in garage openers such as part number Si4012 from SiLabs, together with conventional necessary external components such as a crystal, a power supply, capacitors (not shown in figure). Alternatively control circuit 101 and transmitter 102 may be combined in a single chip such as part number Si4010 also from SiLabs.

A wake-up timer 103 may be either implemented by the firmware program or implemented using functionalities embedded inside wireless transmitter 102. The wake-up timer 103 causes a predetermined preamble bit sequence unique to each different application, followed by the ID information stored in memory 106, to be transmitted in the form of radio wave or electromagnetic field periodically, preferably every few seconds. The preamble bit sequence is used to avoid interference with other radio devices using the same frequency band, and the ID information is used to avoid interference with same tag systems used by other users nearby. The wireless transmitter 102 is only activated during transmission. Since the time it takes to transmit the preamble bit sequence and ID information usually is only a couple tens of milliseconds, average power consumption of the transmitter 102 is reduced by more than an order of magnitude compared with the case if the transmitter is enabled continuously. This method allows operation using a small battery while achieving a long battery life, and combined with conventionally available printed circuit board and IC technologies, small size (form factor) is achieved to allow being carried by a person or a user conveniently.

A light emitting device such as a light emitting diode (LED) 107 is preferably attached to the master tag and can be controlled by control circuit 101. The device 107 may indicate to the user when the battery voltage is dropped below a certain threshold and battery needs to be replaced to allow continued reliable operation of the system.

Figure 1B:
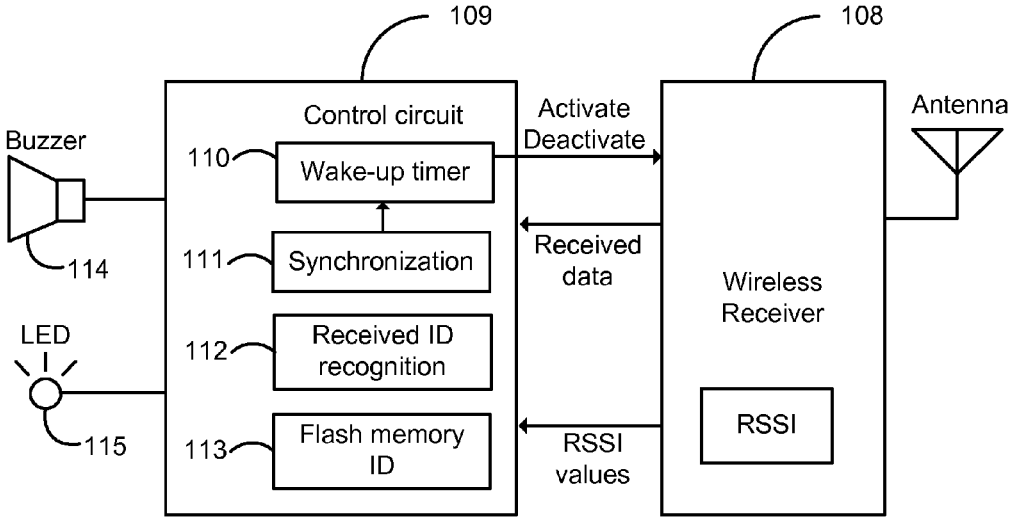
FIG. 1B depicts a functional view of an embodiment of a slave tag of the present invention.

Now referring to FIG. 1B, which shows an embodiment of a slave tag. A control circuit 109 is implemented in a similar way as control circuit 101, preferably using a general purpose microcontroller IC, but a different firmware program is used. A synchronization function 111, and a received ID recognition function 112 are preferably implemented as firmware programs. The synchronization function 111 and a wake-up timer 110 use the control flow shown in FIG. 3 to activate a wireless receiver 108 only during the time transmitter 102 is transmitting, thereby reducing average power consumption of the wireless receiver 108 and increasing battery life.

The wireless receiver 108 is preferably implemented by using a 315 MHz/433 MHz band RF receiver IC such as part number Si4320 from SiLabs, together with conventional necessary external components such as a crystal, power supply, and capacitors (not shown in figure). The receiver 108 may also include a conventional received signal strength indicator (RSSI) which passes information about the strength of wireless signals received to the control circuit 109. Receiver 108 also passes received signal to control circuit 109, where ID recognition function 112 detects preferably using a conventional digital matched filter when received signal contains the preamble bit sequence for the application, followed by the same ID information stored in a memory 113. This step avoids interference with other systems or master tag holders using the same radio frequency band. When detected, the time at which the signal arrived and a RSSI value for that signal is stored in the control circuit 109 for further processing preferably according to the control flow shown in FIG. 3 and FIG. 6.

Figure 3:
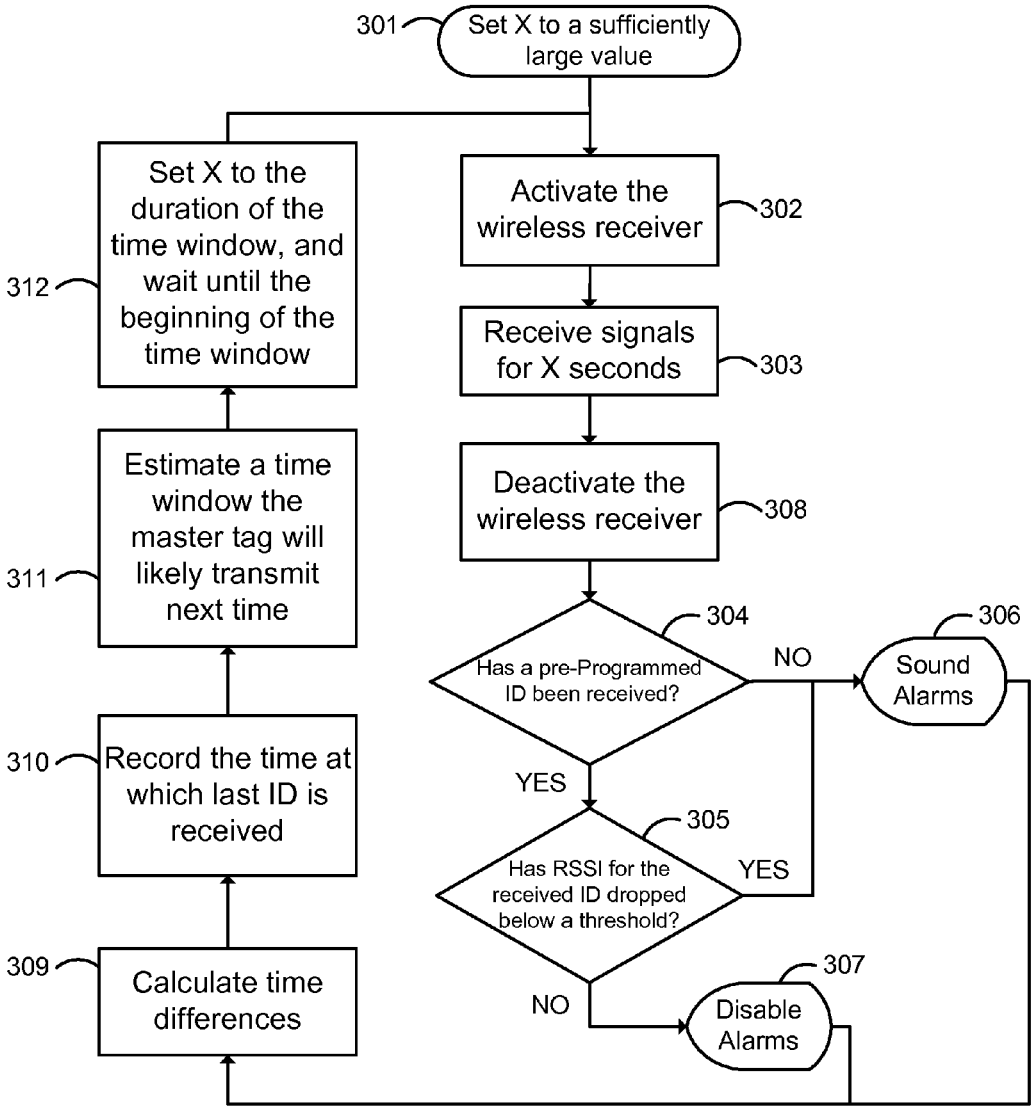
FIG. 3 depicts a preferred control flow chart used by the embodiment shown in FIG. 1B.

A buzzer 114 is attached to the slave tag and controlled by control circuit 109 according to the control flow shown in FIG. 3. The buzzer 114 may be implemented using a piezo buzzer or sound speaker or other types of audible signal generator. A light emitting device such as a light emitting diode (LED) 115 is preferably attached to the slave tag and can be controlled by control circuit 109. The device 115 may indicate to the user when the battery voltage is dropped to below a certain threshold and battery needs to be replaced to allow continued reliable operation of the system. The device 115 may also indicate the status of wireless communication link such as utilized in the control flow shown in FIG. 6.

Figure 1C:
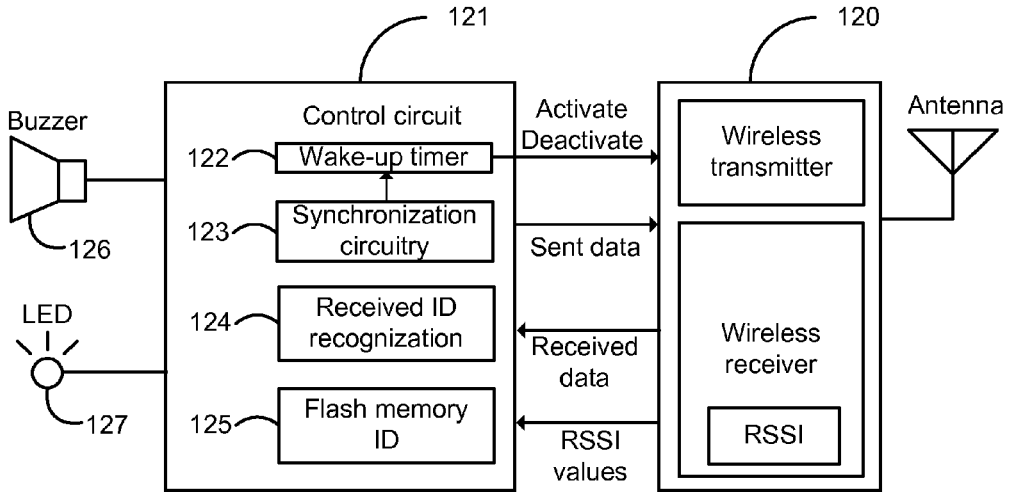
FIG. 1C depicts a functional view of an embodiment of a tag of the present invention, which may be programmed to function either as a master tag or a slave tag.

Now moving to FIG. 1C, where an embodiment of a tag that can function either as a slave tag or a master tag is depicted. A control circuit 121 is implemented in a similar way as control circuits 101 and 109, preferably using a general purpose microcontroller IC. Different control flows (described later with FIG. 4 and FIG. 5) are used depending on whether the tag is configured to function as a master tag or a slave tag. A synchronization function 123, and a received ID recognition function 124 are preferably implemented as firmware programs stored inside the control circuit 121. The synchronization function 123 and a wake-up timer 122 use the control flow shown in either FIG. 4 or FIG. 5, to activate a wireless transceiver (transmitter and receiver) 120 only during the time the coupled tag is transmitting or receiving, thereby reducing average power consumption of the wireless transceiver 120 and increasing battery life.

The wireless transceiver 120 is preferably implemented by using a 315 MHz/433 MHz band RF transceiver IC such as part number Si4420 from SiLabs, together with conventional necessary external components such as a crystal, power supply, and capacitors (not shown in figure). The transceiver 120 may also include a conventional received signal strength indicator (RSSI) which passes information about the strength of wireless signals received to the control circuit 121. Transceiver 120 also passes received signals to control circuit 121, where the ID recognition function 124 detects preferably using a conventional digital matched filter when received signal contains the preamble bit sequence for the application, followed by the same ID information stored in a memory 125. When detected, the time at which the signal arrived and RSSI value for that signal is stored in the control circuit 121 for further processing according to either control flow shown in FIG. 4, FIG. 5, and FIG. 6.

Figure 4:
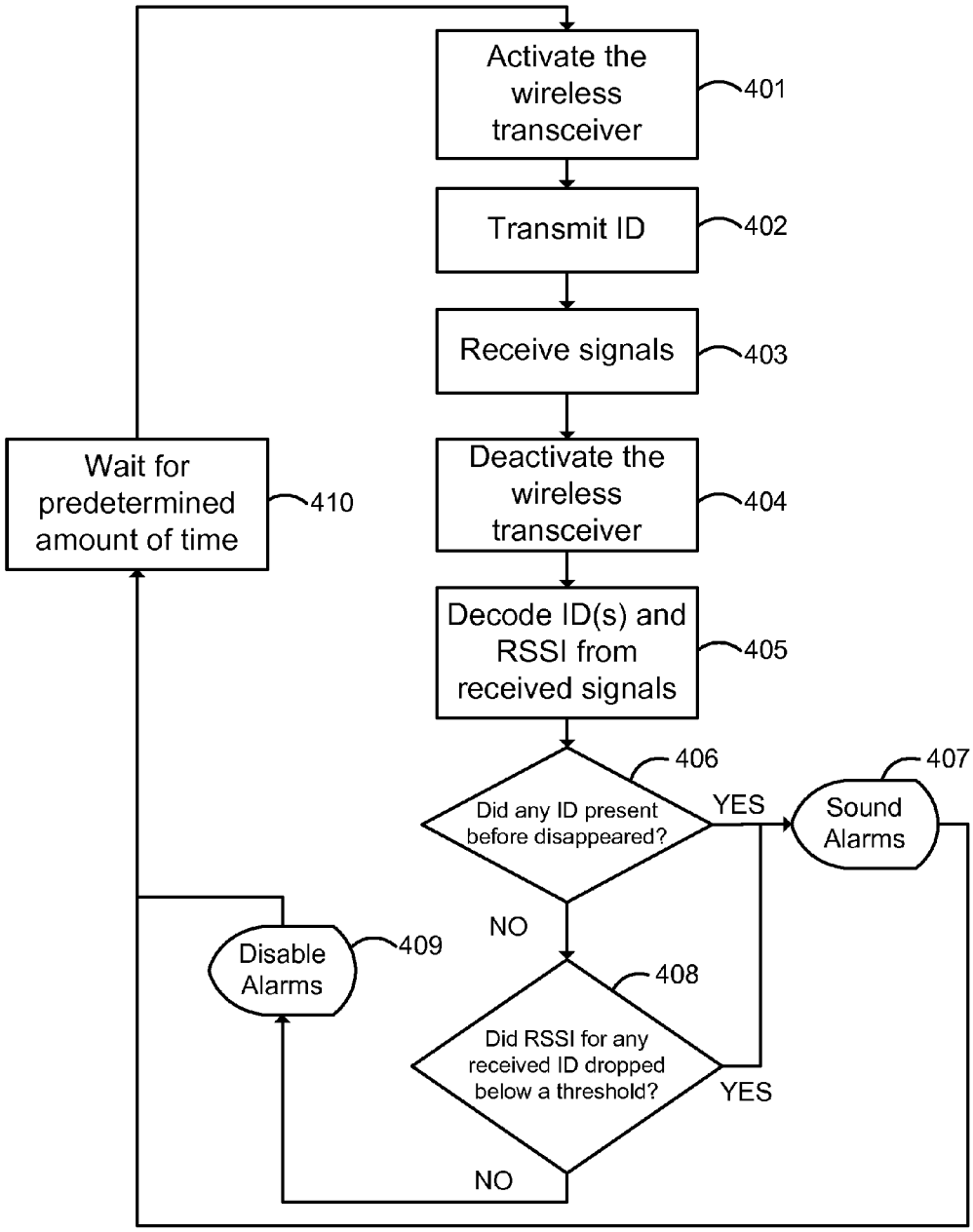
FIG. 4 depicts a preferred control flow chart used by the embodiment shown in FIG. 1C, functioning as a master tag.
Figure 5:
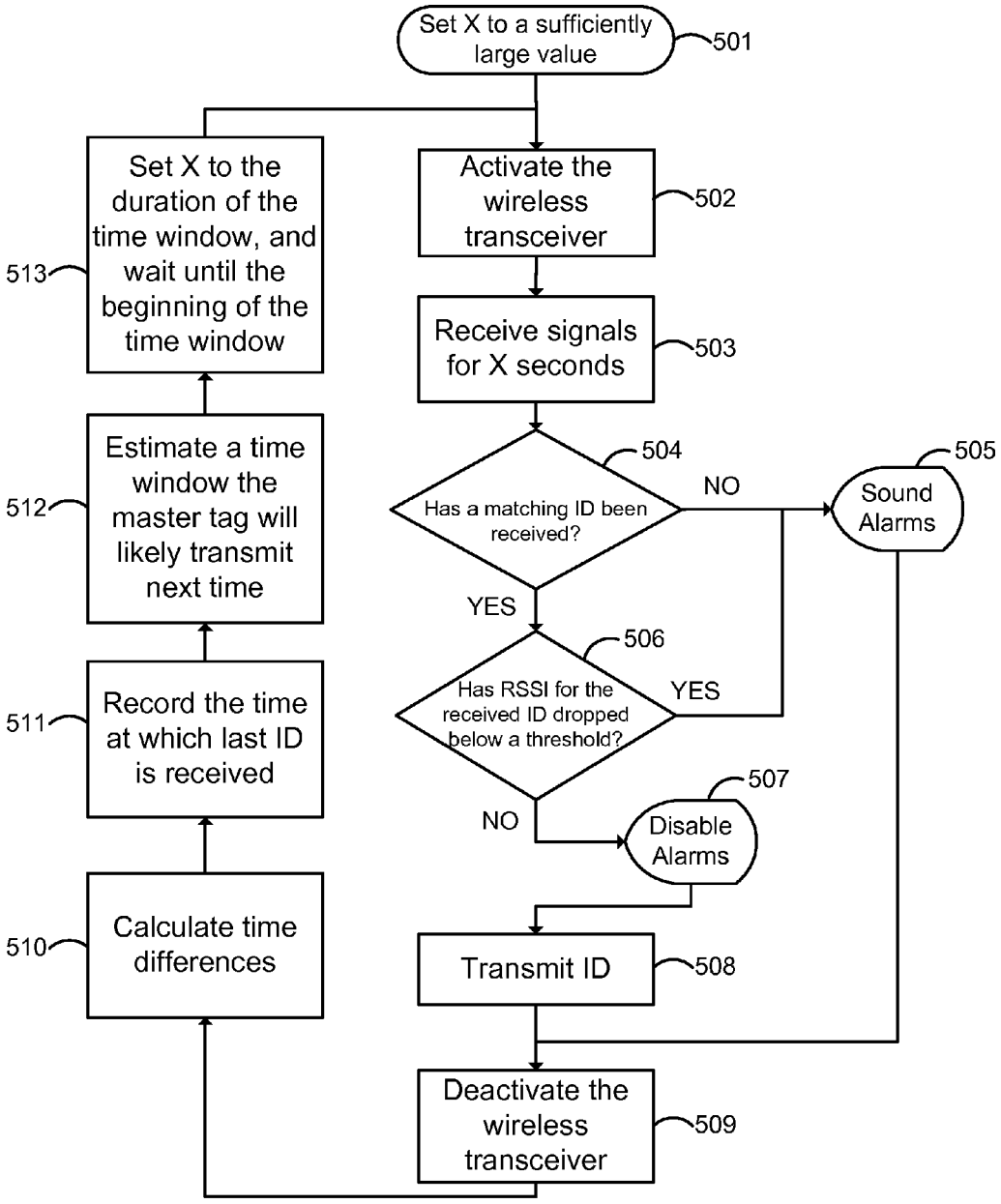
FIG. 5 depicts a preferred control flow chart used by the embodiment shown in FIG. 1C, functioning as a slave tag.

A buzzer 126 is attached to the tag and controlled by the control circuit 121 according to the control flow shown in FIG. 4 or FIG. 5. The buzzer 126 may be implemented using a piezo buzzer or sound speaker or other types of audible signal generator. A light emitting device such as a light emitting diode (LED) 127 is preferably attached to the tag and can be controlled by the control circuit 121. The device 127 may indicate to the user when the battery voltage is dropped to below a certain threshold and the battery needs to be replaced to allow continued reliable operation of the system. The device 127 may also indicate the status of wireless communication link as utilized in the control flow shown in FIG. 6.

Operation

Figure 2:
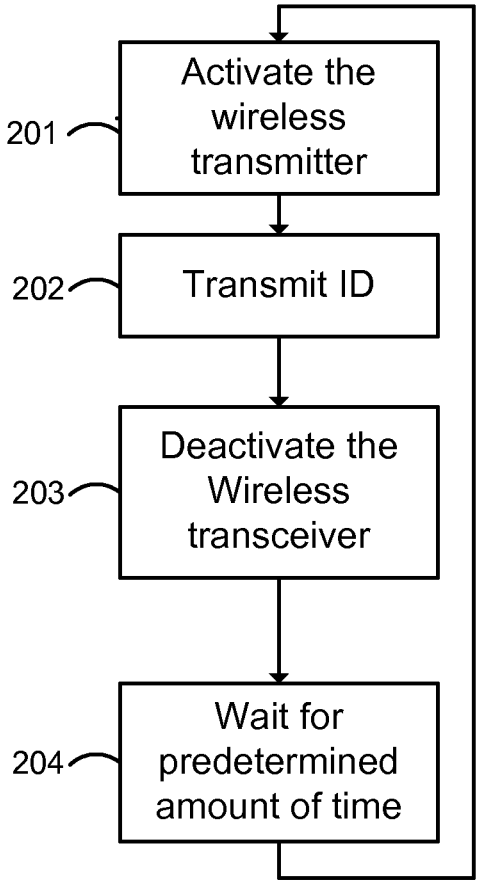
FIG. 2 depicts a preferred control flow chart used by the embodiment shown in FIG. 1A.

FIG. 2 depicts a control flow used by the embodiment shown in FIG. 1A. This control flow can be implemented as a firmware program or as digital hardware using finite state machine. In step 201, the control circuit 101 activates the wireless transmitter 102. In step 202, the ID information stored in the memory device 106 is transmitted together with the preamble bit sequence, which may also be stored in the memory device 106 or in a read-only memory device. In step 203, the control circuit deactivates the wireless transmitter 102. In step 204, the control circuit 101 preferably puts other circuits except the wake-up timer 103 into power down mode in order to conserve power, and instructs the wake-up timer 103 to wake up after a predetermined amount of time, which is chosen according to the application, that is, based on how soon the user desires to be notified when a slave tag gets a certain distance away from the master tag.

FIG. 3 depicts a control flow used by the embodiment shown in FIG. 1B. This control flow can be implemented as a firmware program or as digital hardware using a finite state machine. In step 301, a variable X, which determines the amount of time to keep receiving wireless signal, is set to a predetermined value large enough to allow receiving multiple packets of wireless signal from the master tag. In step 302, the control circuit 109 activates the wireless receiver 108. In step 303, the control circuit 109 receives data from the receiver 108 for X seconds and stores all received data. Subsequently, in step 308 the wireless receiver circuit is deactivated to conserve power. In step 304, the control circuit 109 uses a conventional matched filter algorithm to detect the presence of the preamble bit sequence from received data, and if present, the data immediately following the preamble bit sequence is extracted as ID information, and the timestamp at which the preamble bit sequence was first received by the receiver 108 is recorded. For the embodiment shown in FIG. 1A and FIG. 1B, the ID information consists of only the ID used to identify the master tag. The received preamble bit sequence and ID information will be referred hereafter as "signal packet". At the same time a received signal strength indictor (RSSI) value may also be recorded. This action is repeated until all of the received data are analyzed, and as a result, one or more signal packets, associated RSSI values and timestamps may be obtained.

Alternatively, step 304 can be executed concurrently with step 303 to extract useful information (including ID information, RSSI values, and time information) from the received data as they arrive, so that only extracted signal packets need to be stored to reduce necessary memory space.

Then, the control circuit 109 searches if any of the extracted signal packets contain ID information matches the ID information associated with the master tag stored in memory 113. If not, in step 306 the buzzer 114 is activated to emit audible warning signal. If matching ID information is present, the timestamps t(1), t(2), . . . , t(N) (N is equal or greater than 1) at which packets of wireless signal containing matching ID information were received are recorded for later use. Then in step 305, the control circuit uses the recorded RSSI value to estimate the physical distance to the transmitter 102, hence to the master tag. If the estimated distance is longer (RSSI value is smaller) than certain thresholds, step 306 is executed. If not, in step 307 the buzzer 114 is deactivated such that if an audible signal is being emitted it is stopped.

In step 309, if N is greater than 1, a time interval tD is calculated as tD=t(N)−t(N−1). If N is 1, tD is calculated as tD=t(N)−t_prev, where t_prev is a register in control circuit 109. In step 310, ON) is stored for use by the next receive cycle in the register t_prev. This calculation effectively estimates the period of wake-up timer 103 in the master tag. The next time the wireless transmitter is likely to transmit can then be estimated as t_prev+tD. Since t_prev and t(N) are continuously updated each time the slave tag receives a signal packet from the master tag, any slight period difference between wake-up timer 103 and wake-up timer 110, that may accumulate over time and cause loss of synchronization, is eliminated. More sophisticated approaches such as having M (M>1) registers for storing received timestamps for previous M packets, and calculating the next time the transmitter is likely transmit using various conventionally known extrapolation algorithms may also be used.

In step 311, a time window is defined with a beginning time t_begin and an ending time t_end, which are preferably estimated using the following equations: t_begin=t_prev+tD−t_window/2, and t_end=t_prev+tD+t_window/2, where t_window is a predetermined value to allow a margin for any estimation error, to ensure reliable reception of transmitted signal by the master tag. In step 312, the variable X is set to t_window such that in step 303 the receiver is kept activated during the time window. Since t_window can be typically set to tens of milliseconds in the present embodiment, and it is typically sufficient to notify a user the event of a slave tag getting too far away within a couple of seconds (hence the wake-up timer period can be a couple of seconds), the system and method described here have significant advantages for reducing average power consumption, while allowing reliable wireless links by choosing a large enough value for t_window.

FIG. 4 depicts a control flow chart used by the embodiment shown in FIG. 1C, functioning as the master tag. This control flow can be implemented as a firmware program or as digital hardware using a finite state machine. In step 401, the control circuit 121 activates the wireless transceiver 120. In step 402, the ID information stored in memory device 125 is transmitted together with the preamble bit sequence, which may also be stored in memory device 125 or in a read-only memory device. Immediately following step 402, in step 403, the transceiver 120 receives wireless signals for a predetermined amount of time, which is long enough to receive signals transmitted in step 508, by all slave tag embodiments shown in FIG. 1C, that are wirelessly coupled to the present master tag. In step 404, the control circuit 121 deactivates the wireless transceiver 120.

In step 403 and 405, a similar algorithm as used in step 303 and 304 is used to extract one or more signal packets containing ID information. The difference is that the ID information contained in a signal packet that is transmitted by a slave tag for the embodiment shown in FIG. 1C consists of the preamble bit sequence, followed by a first ID used to identify the master tag, followed by a second ID used to identify each slave tag (each slave tag has different ID). The control circuit 121 discards any signal packet with the first ID not matching the ID associated with the present master tag, and records any signal packet with the first ID matching the ID associated with the present master tag. This step avoids interference from signals emitted by other pairs of master and slave tags in use nearby. At the same time, a received signal strength indictor (RSSI) value may also be recorded. These steps are repeated until all received data are analyzed, and as a result, one or more signal packets and RSSI values may be recorded.

The control circuit 121 maintains a table in memory of all the second IDs received during step 403 executed ever since a system reset. In step 406, the control circuit checks if all of the IDs stored in the table has been received in the preceding step 403. If some have not been received, in step 407 the buzzer 126 is activated to emit audible warning signals. The audible warning signals may be customized or different depending on which slave tag ID is missing. The LED 127 may also be used to give warning to the user. If all have been received, in step 408 the RSSI value is used to estimate the distance and is checked against a threshold. If the estimated distance is longer (RSSI value is smaller) than the threshold, step 407 is executed. If not, in step 409 the buzzer 126 is deactivated such that if an audible signal is being emitted it is stopped. In step 410 similar actions are taken as in step 204 in order to conserve power.

FIG. 5 shows a control flow chart used by the embodiment shown in FIG. 1C, now functioning as a slave tag. In step 501, a variable X, which determines the amount of time to keep receiving wireless signal, is set to a predetermined value large enough to allow receiving multiple packets of wireless signal from the master tag.

In step 502, the control circuit 121 activates the wireless transceiver 120. Step 503, 504, 506, and 508 are executed concurrently for X seconds. The purpose of concurrent execution is to allow, after receiving a matching ID in step 504, transmission of a response back to the master tag in step 508 immediately or after a predetermined wait time (which can be dynamically determined in step 608 using the flow shown in FIG. 6). The wait time is provided to avoid multiple slave tags to transmit to a single master tag at the same time. An example of transmitted and received signals during these steps is shown in FIG. 7. In step 503, the control circuit 121 receives data from the transceiver 120. Concurrently, in step 504, the control circuit 121 uses a conventional matched filter algorithm to detect the presence of the preamble bit sequence from received data, and if present, the data immediately following the preamble bit sequence are extracted as ID information, which consists of the ID used to identify a master tag. At the same time a received signal strength indictor (RSSI) value may also be recorded. The control circuit 121 discards any signal packet whose ID information does not match the ID information stored in memory 125 associated with the master tag to which the present slave tag is coupled (referred hereafter as "ID_0"). Optionally in step 506 the RSSI value recorded is used to estimate the physical distance to the transmitter, and estimated distance is verified to be shorter than a threshold. If longer than the threshold, the control circuit 121 discards the signal packet and keeps receiving in step 503 until the X seconds expire. When a packet with matching ID information is received and also and passes the test of step 506, after the predetermined wait time, the control circuit 121 transmits a response consisting of the preamble bit sequence, the ID_0, and a unique ID associated with the present slave tag. The timestamps t(1), t(2), . . . , t(N) (N is equal or greater than 1) at which signal packets containing a matching ID were received are recorded for later use.

If after the X seconds, no signal packet containing a matching ID was received, or optionally no signal packet containing a matching ID and sufficient RSSI value is received, in step 506, buzzer 126 is activated to emit audible warning signals. Otherwise, in step 507, the buzzer 126 is deactivated such that if an audible signal is being emitted it is stopped. After the X seconds, step 509 is executed to deactivate the wireless transceiver 120 to conserve power.

In step 510, if N is greater than 1, a time interval tD is calculated as tD=t(N)−t(N−1). If N is 1, tD is calculated as tD=t(N)−t_prev, where t_prev is a register in the control circuit 121. In step 511, t(N) is stored for use by the next receive cycle in the register t_prev. This calculation effectively estimates the period of the wake-up timer in the master tag. In step 512, a time window is defined with a beginning time t_begin and an ending time t_end, which are preferably estimated using the following equations: t_begin=t_prev+tD−t_window/2, and t_end=t_prev+tD+t_window/2, where t_window is a predetermined value to allow a margin for any estimation error, to ensure reliable reception of transmitted signal by the master tag. In step 513, the variable X is set to t_window such that in step 503, 504, 506, and 508, the receiver portion in transceiver 120 is kept activated during the time window. The transmitter portion in transceiver 120 may be kept activated slightly longer due to the wait time mentioned previously and shown in FIG. 7.

Figure 6:
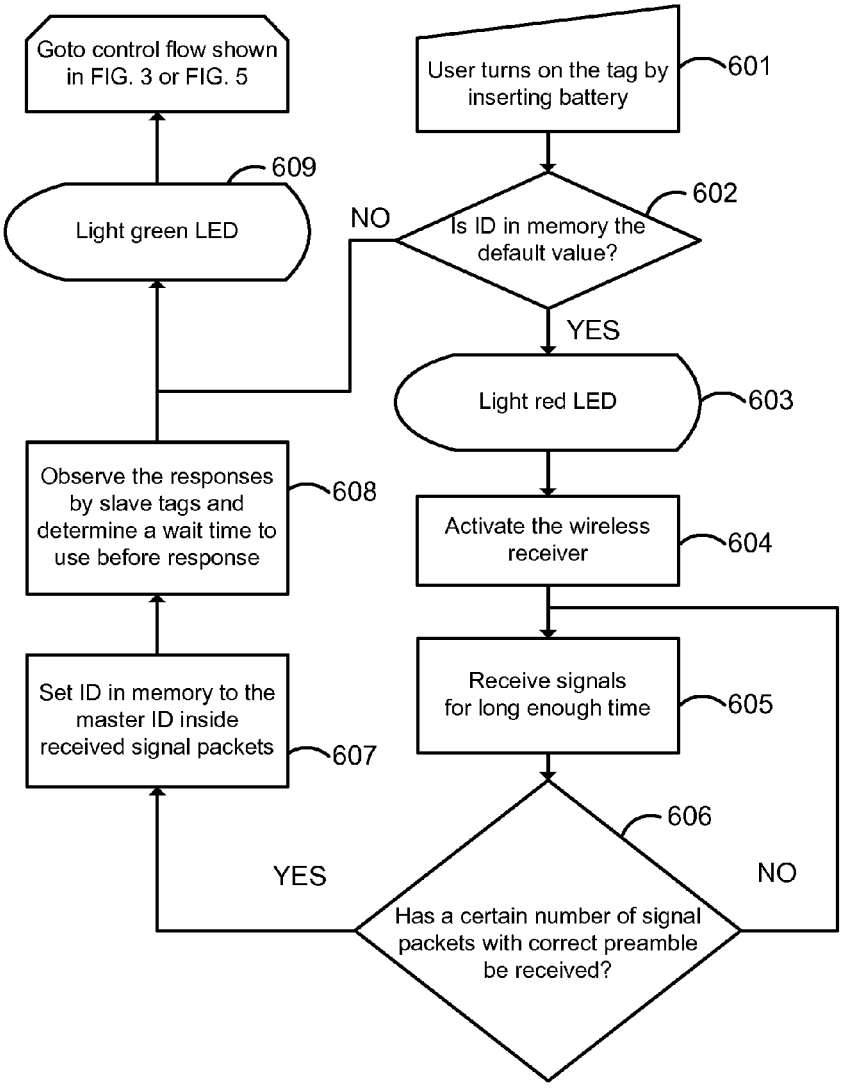
FIG. 6 depicts a control flow chart which can be used by either the embodiment in FIG. 1B or FIG. 1C, in an initial state in which the slave tag embodiment may or may not have been paired with a master tag.
Figure 7:
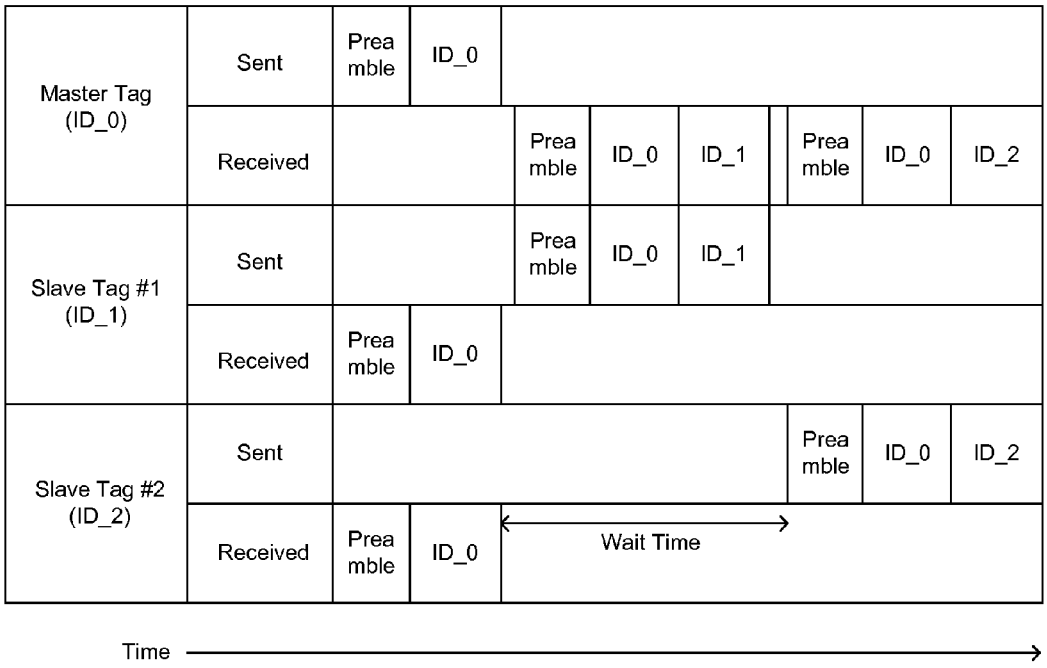
FIG. 7 depicts a timing diagram used by the embodiment shown in FIG. 1C, illustrating sent and transmitted wireless signals by a master tag and two slave tags vs. time.

FIG. 6 depicts a control flow chart used by the slave tag of embodiment 1B or 1C, at an initial state, in which state the slave tag may or may not have been paired with the master tag. Typically, the system of the present invention comprises of one master tag and one or more slave tags, which are preprogrammed in factory to be paired with each other, by storing the same ID_0 in the non-volatile memory device of all tags. However, the user may later wish to purchase additional slave tags and add them into the system. There is provided a cost-effective (because no new hardware or factory programming in needed) and a convenient method for the user to pair a newly added slave tag with the master tag.

In step 601, typically the newly added slave tag is powered on by the user or put into a reset state. This is done preferably in a private location and in the proximity of the master tag to which the user intends to pair, and all other slave tags already paired with that master tag. In step 602, the control circuit 121 or 109 reads the master ID stored in memory 125 or 113 and check if it is a default (reset) value, such as "000000". If not, it means the slave tag has already been associated with a master tag and control is moved on to step 609, where LED 127 or 115 can be used to notify the user that the ID is not the default value. Otherwise, in step 603 the LED 127 or 115 can be used to notify the user that the ID is the default value and the tag is not yet been paired. In step 604, the control circuit 121 or 109 activates the wireless transceiver 120 or wireless receiver 108. Step 605 is similar to step 303 or step 503, where control circuit 121 or 109 receives wireless signal and searches for the preamble bit sequence using a matched filter, stores the ID information following the preamble, and recognizes as a valid signal packet. Step 605 and step 606 are repeated indefinitely until a predetermined number of valid signal packets are received. Next in step 607 the first ID information, equivalent to ID_0 shown in FIG. 7, is stored in memory 125 or 113. For embodiment shown in FIG. 1C, in the next step 608, the control circuit 121 further analyzes received signal packets to identify those sent by other slave tags, the wait time used by each slave tag. Then the control circuit calculates a wait time longer than the longest wait time plus the time duration of the signal packet sent by a slave tag, and stores it in memory for later use. Finally in step 609, LED 127 or 115 can be used to notify the user that the pairing is complete.

We claim:

1. A system for preventing person, animal or items from getting lost comprising, one master tag and at least one slave tags, wherein said master tag is wirelessly coupled to each one of said slave tags, said master tag and said slave tag being capable of being conveniently carried by a person or being attached to an animal or a personal item, wherein said master tag comprising:

a first control circuit;

a memory device coupled to said first control circuit for storing an identification information;

a wireless transmitter circuit coupled to said first control circuit for transmitting wireless signals containing said identification information when activated; and a first wake-up timer circuit coupled to said first control circuit for periodically generating a wake-up signal to activate or de-activate said wireless signal transmitter circuit, whereby significantly reducing average power consumption of said master tag to allow a longer battery life;

said slave tag comprising:

a second control circuit;

a wireless receiver circuit coupled to said second control circuit for receiving wireless signals transmitted by said wireless transmitter circuit;

a memory device coupled to said second control circuit for storing an identification information; and a means coupled to said second control circuit for estimating physical distances between said master tag and said slave tag; and an audible signal generator circuit coupled to said second control circuit for generating audible signals upon activation by said second control circuit when estimated physical distance is longer than a predetermined threshold, thereby giving warning to the person or animal carrying the slave tag and at the same time also helping the user locating the person, animal, or item; and a second wake-up timer circuit coupled to said second control circuit for periodically generating a wake-up signal to activate or de-activate said wireless signal receiver circuit, thereby significantly reducing average power consumption of said slave tag to allow a longer battery life; and a synchronization circuit coupled to said second control circuit for estimating based on received signals, the wake-up period of the first wake-up timer circuit in said master tag, and substantially matching the wake-up period of the second wake-up timer circuit in said slave tag to the estimated period.

2. The system of claim 1,wherein said means for estimating physical distance comprises of a device selected from the group consisting of a received signal strength indictor circuit, and a circuit that indicates whether or not a signal with matching identification information has been received.

3. The system of claim 1, wherein said slave tag further includes a circuit for deactivating said audible signal generator circuit automatically when estimated physical distance is shorter than a predetermined threshold.

4. The system of claim 1, wherein said master tag further includes at least one device for emitting visible light for indicating status of the system.

5. The system of claim 1, wherein said slave tag further includes at least one device for emitting visible light for indicating status of the system.

6. The system of claim 1, wherein said master tag further includes a wireless receiver circuit coupled to said first control circuit receiving wireless signals containing identification information;

a means coupled to said first control circuit for estimating physical distances between said master tag and said slave tag; and an audible signal generator circuit coupled to said first control circuit for generating audible signals upon activation by said first control circuit when estimated physical distance is longer than a predetermined threshold, thereby giving warning to the user, and, said slave tag further includes:

a wireless transmitter circuit coupled to said second control circuit for transmitting wireless signals containing identification information, thereby allowing said master tag to estimate physical distance between said slave tag and said master tag using received signal from said slave tag.

7. The system of claim 6, wherein said master tag further includes:

the first wake-up timer circuit coupled to said first control circuit for periodically generating a wake-up signal to activate or de-activate said wireless signal transceiver circuit, thereby significantly reducing average power consumption of said master tag to allow a longer battery life;

and, said slave tag further includes:

the second wake-up timer circuit coupled to said first control circuit for periodically generating a wake-up signal to activate or de-activate said wireless signal transceiver circuit, thereby significantly reducing average power consumption of said slave tag to allow a longer battery life.

8. The system of claim 6, wherein said master tag means for estimating physical distance comprises of a device selected from the group consisting of a received signal strength indictor circuit and a circuit that indicates whether or not a signal with matching identification information has been received.

9. The system of claim 6, wherein said slave tag means for estimating physical distance comprises of a device selected from the group consisting of a received signal strength indicator circuit and a circuit that indicates whether or not a signal with matching identification information has been received.

10. The system of claim 6, wherein said master tag and slave tag further include a circuit for deactivating said audible signal generator circuit automatically when estimated physical distance is shorter than a predetermined threshold.

11. The system of claim 6, wherein said master tag and slave tag further include a plurality of non-volatile memory device to store identification information to prevent such information from being lost when power supply is absent.

12. The system of claim 6, wherein said master tag further includes at least one light emitting diode for indicating status of the system.

13. The system of claim 6, wherein said slave tag further includes at least light emitting diode for indicating status of the system.

14. A method for reducing average power consumption of a wirelessly coupled transmitter and receiver circuit for application in preventing person, animal or items from getting lost, comprising the steps of:

activating a wireless receiver;

receiving for a sufficiently long period of time such that multiple signals from a wireless transmitter can be received;

deactivating said wireless receiver;

calculating a time interval based on the information about when each signal is received;

estimating the next time said wireless transmitter is likely to transmit by adding the time interval and the time when the last signal is received;

re-activating said wireless receiver before the estimated time;

recording the time at which a signal is received from said wireless transmitter;

and calculating the time difference from the previous time a signal is received from said wireless transmitter; and updating the estimate of the next time said wireless transmitter is likely to transmit.

15. A method in accordance with claim 14 and comprising the additional step of determining if a received signal contains a pre-programmed identification information, and if not present, activating an audible signal generator

16. A method in accordance with claim 14 and comprising the additional step of determining if received signal contains a pre-programmed identification information, and if present, determining the received signal strength, and if the signal strength is less than a threshold, activating an audible signal generator.

* * * * *